US007182715B2

(12) United States Patent
Anderson

(10) Patent No.: US 7,182,715 B2
(45) Date of Patent: Feb. 27, 2007

(54) KETTLEBELL

(75) Inventor: Karl Anderson, Glendora, CA (US)

(73) Assignees: Ace Specialty, Inc., Rosemead, CA (US); Grace Premier Fitness & Wellness, Inc., Vancouver, WA (US)

( * ) Notice: Subject to any disclaimer, the term of this patent is extended or adjusted under 35 U.S.C. 154(b) by 88 days.

(21) Appl. No.: 10/417,511

(22) Filed: Apr. 17, 2003

(65) Prior Publication Data

US 2004/0005970 A1 Jan. 8, 2004

Related U.S. Application Data

(63) Continuation-in-part of application No. 29/163,482, filed on Jul. 5, 2002, now Pat. No. Des. 481,771.

(51) Int. Cl.
*A63B 21/072* (2006.01)

(52) U.S. Cl. ..... 482/93; 482/108

(58) Field of Classification Search ..... 482/20–22, 482/44, 49, 50, 93, 94, 104–109; D21/681, D21/682

See application file for complete search history.

(56) References Cited

U.S. PATENT DOCUMENTS

| | | | | |
|---|---|---|---|---|
| 1,316,683 | A * | 9/1919 | Calvert | 482/93 |
| D194,042 | S * | 11/1962 | Guthormsen | D21/681 |
| 3,219,343 | A * | 11/1965 | Steiner | 482/106 |
| 4,431,185 | A * | 2/1984 | Cisneros | 482/93 |
| 4,714,246 | A * | 12/1987 | Parisien | 482/110 |
| 4,730,828 | A * | 3/1988 | Lane | 482/94 |
| 5,540,640 | A * | 7/1996 | Povilaitis | 482/108 |
| 2003/0162637 | A1 * | 8/2003 | Smithberg | 482/93 |
| 2003/0232704 | A1 * | 12/2003 | Bowman et al. | 482/107 |

FOREIGN PATENT DOCUMENTS

| | | | |
|---|---|---|---|
| SU | 1662589 | A1 * | 7/1991 |
| SU | 1667880 | A2 * | 8/1991 |
| WO | WO 200123043 | A1 * | 4/2001 |
| WO | WO 2004007030 | A1 * | 1/2004 |

OTHER PUBLICATIONS

German article "Die erste Figurhantel fur die Lady", 1983, pp. 104-105.*

* cited by examiner

*Primary Examiner*—Jerome Donnelly
*Assistant Examiner*—Victor K. Hwang
(74) *Attorney, Agent, or Firm*—Seldon & Scillieri

(57) ABSTRACT

A kettlebell is disclosed herein having, in its preferred embodiment, a pair of oppositely-facing, generally frustum-shaped weightplates disposed about a first axis that is perpendicular to the axis of its handle. The frustum shape reduces the force of impact against the user's forearm during certain exercise movements. The preferred handle includes places which can be held between the user's thumb and remaining fingers for improved control during other exercise movements.

11 Claims, 6 Drawing Sheets

KETTLEBELL

This is a continuation-in-part of U.S. patent application Ser. No. 29/163,482 filed Jul. 5, 2002, now issued as U.S. Design Pat. D481,771 S issued Nov. 4, 2003.

BACKGROUND OF THE INVENTION

This invention relates to exercise devices and, more specifically, to exercise devices utilizing weight resistance.

Once type of exercise device that utilizes weight resistance is known as a kettlebells. Kettlebells have traditionally comprised a cast iron weight that looks much like a basketball with a suitcase-type handle attached to the top. It has been used for hundreds of years to provide weight training for the entire body, producing a high degree of strength training as well as an aerobic workout.

A number of kettlebell exercises require the user to perform body movements that cause the weight to fall against the user's forearm as the handle is loosely gripped during the exercise to permit such movement. The force of impact of the weight against the forearm, is quite strong, in that the entire weight of the kettlebell impacts the forearm over a very small contact area. Such impacts, particularly when repetitive, can cause discomfort, bruising and other damage.

SUMMARY OF THE INVENTION

In accordance with the invention, a kettle bell is provided having a generally oblique arm-contacting surface positioned to impact the user's arm over a greater surface area and thereby disperse the force against the arm. At the same time, the arm-contacting surface is configured to substantially reduce improper flexure of the user's wrist during the exercise, thereby improving the user's form and consequential workout effectiveness, and minimizing the chance for injury.

These and further details of the invention will be apparent to those of ordinary skill in the art from reading a description of the preferred embodiment of the invention described below, and of which the drawings form a part.

IN THE DRAWINGS

FIG. 1 is a front perspective view of a preferred embodiment of a kettle bell constructed in accordance with the invention;

DESCRIPTION OF THE PREFERRED EMBODIMENT

Referring initially to FIGS. 1–5, a preferred kettlebell 10 constructed in accordance with the invention. The kettlebell 10 preferably comprises a flat, steel, central plate 12 generally disposed about the major axis 13 of the kettlebell. The central plate is preferably ⅛ inch to 1 inch thick, and can be either square, rectangular, round, or any other desirable shape. Those skilled in the art will recognize that numerous other materials may be used to form the plate so long as the material has the requisite degree of strength to fulfill its function.

Figure 8:
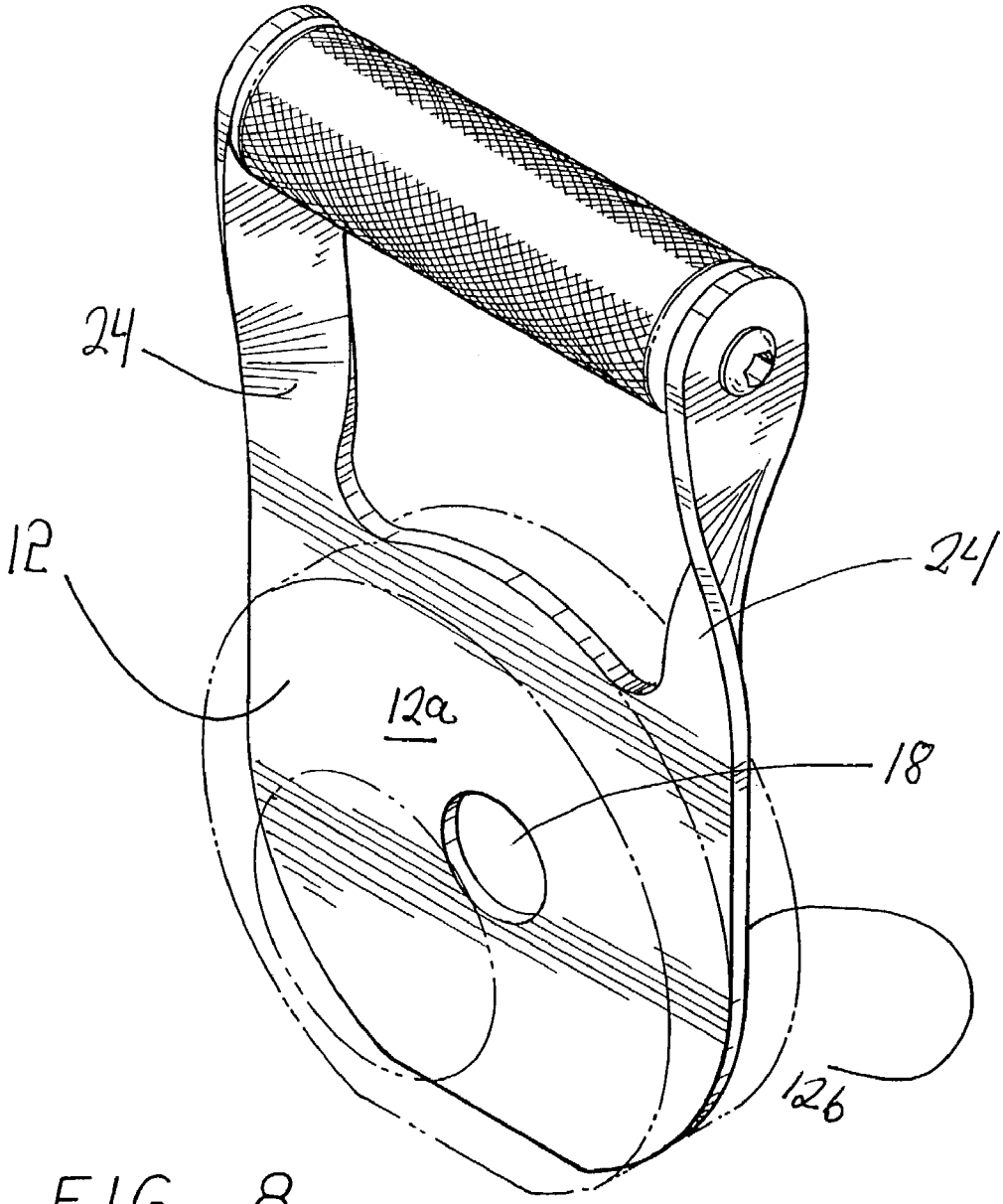
FIG. 8 is a front perspective view of a preferred means for coupling the weightplates to the handle of a kettle bell constructed in accordance with the invention.

The central plate 12 has opposite faces 12*a*, 12*b* to which weight plates 20 are mounted. One or more holes 18 (FIG. 8) are drilled through the central plate 10 to accommodate a shaft of 1–2 inches in diameter that extends from the rear face of each weightplate. As described in more detail below, the shaft allows for the secure assembly of the weight plates 20 onto the flat plate 10.

A pair of stems 24 are welded to, or integrally formed with, diametrically opposite sides of the central plate, and extend upwards generally orthogonally to the kettlebell's major axis 13 to opposite ends of a generally cylindrical handle 22 that is gripped by the user during the exercise movement. The handle extends along an axis 23 that is generally perpendicular to the kettlebell's major axis as well as to the paths of the stems. Each of the stems 24 has a twist so that their respective top and bottom lateral surfaces rotate approximately 90° about their respective axis of travel. The graspable handle 22 is preferably mounted to the stems for rotation about its axis 23 to permit the weight plates 20 to move in a pivoting manner during exercise movements.

Each weight plate 20 is formed about a central axis that is aligned with the major axis of the kettlebell when the weight plate is mounted to the central plate. Each weight plate 20 comprises a generally cylindrical portion 30*a* that abuts the central plate 10, and an integrally formed frustum-shaped portion 30*b* that extends axially outward from the cylindrical portion.

Figure 6:
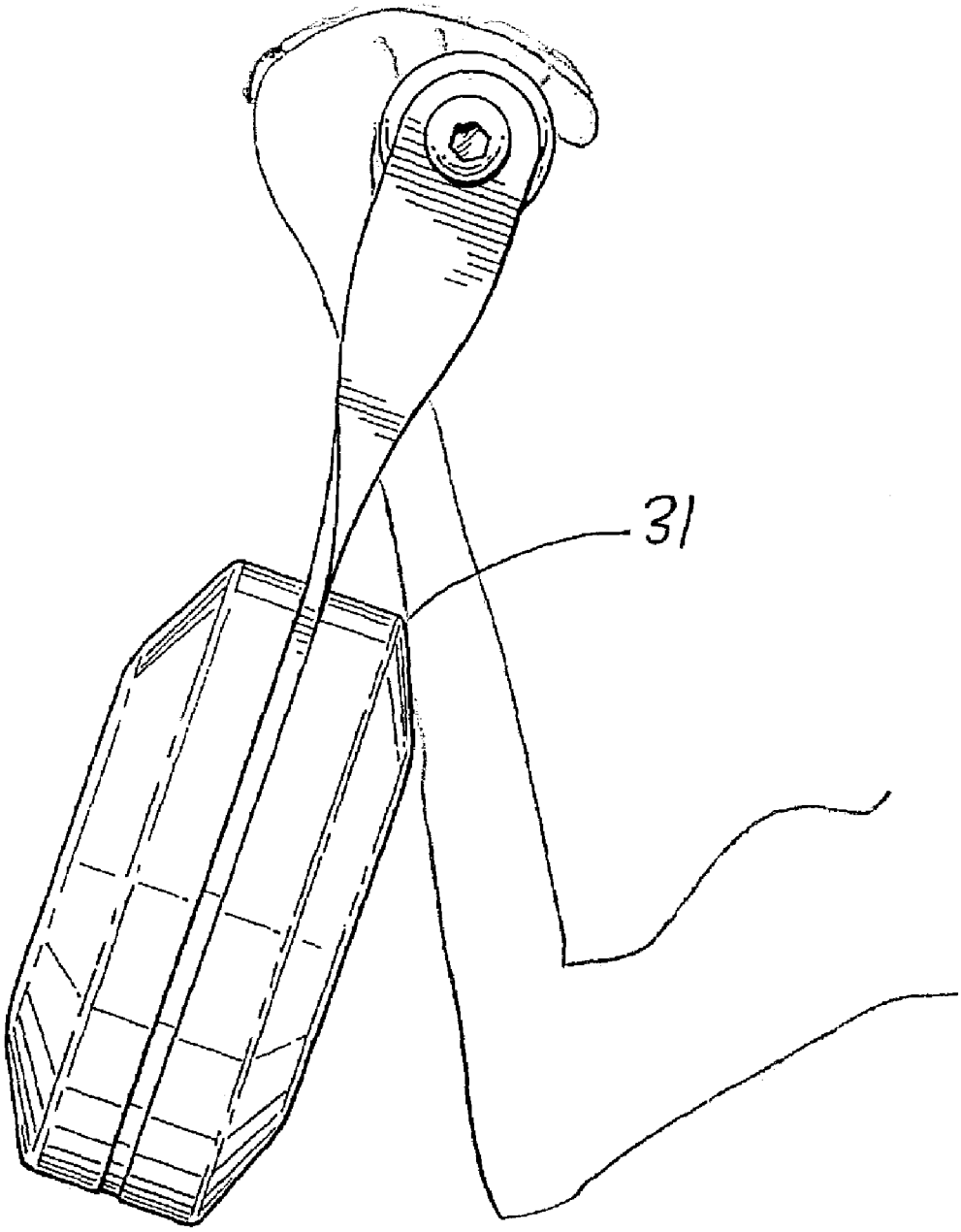
FIG. 6 illustrates an exercise position of the kettlebell of FIG. 1.

The generally oblique side surface 30*c* of the frustum-shaped portion 30*b* provides a relatively broad contact surface with the user's forearm, as illustrated in FIG. 6, thereby dissipating the force of impact over a substantially greater area than conventional kettlebells. In addition, any attempt to flex the wrist results in an attempted pivoting movement of the kettlebell at a fulcrum point 31, resulting in a counter-torque of the weight about that fulcrum to counter the attempted wrist flex. The counter-torque provides clearly perceived tactile feedback to the user that the user is attempting to flex the wrist. Moreover, the exertion of the counter-torque at the fulcrum point makes the attempted flex very difficult or, alternatively, very uncomfortable so that it effectively prevents flexing from taking place.

To further blunt the impact of the kettlebell against the forearm, the rearward edge 35 of the oblique side surface 30*c* is preferably provided with a slight radial curve. In practice, a radius of curvature of one inch has been found suitable.

In the preferred embodiment, kettlebells are provided with dimensions that accomplish the functions as described above, and the dimensions are maintained within a preferred range by utilizing aluminum for the lighter kettlebells and utilizing steel for the heavier ones. Thus, 10 lb. and 15 lb. kettlebells have aluminum weightplates, with the cylindrical portion of the weight plate being approximately 5.9 inches in diameter. The plate is manufactured from 6-inch diameter stock, but is turned down to approximately 5.9 inches to obtain a smooth surface quality. The kettlebells weighing 20 lbs. through 40 lbs. preferably have steel weightplates approximately 5.9 inches in diameter. Kettlebells weighting 45 lbs. through 75 lbs. have steel weightplates that are approximately 7.9 inches in diameter, having been formed from 8-inch diameter stock.

The remaining dimensions of the weight plates vary to accomplish the intended purpose. The width W and frustum angle A (illustrated in FIG. 5) of the foregoing weightplates, are preferably the values shown in Table 1, below.

TABLE 1

| | W (inches) | A (degrees) |
|---|---|---|
| 10 lb. | 1.3 | 29 |
| 15 lb. | 2.316 | 40 |
| 20 lb | 1.3 | 29 |
| 25 lb | 1.625 | 34 |
| 30 lb | 2.0 | 37 |
| 35 lb | 2.375 | 40 |
| 40 lb | 2.75 | 45 |
| 45 lb. | 1.67 | 30 |
| 50 lb. | 1.87 | 37.5 |
| 55 lb. | 2.07 | 39 |
| 60 lb. | 2.27 | 41 |
| 65 lb. | 2.48 | 43 |
| 70 lb. | 2.665 | 44 |
| 75 lb. | 2.85 | 45 |

The angle of the frustum is a function of the angle at which the weight contacts the user's forearm during the exercise movement. As the depth W of the plate increases, the angle A increases owing to the geometric relationship between the user's forearm and the position of the kettlebell as can be appreciated from FIG. 6. Accordingly, the surface 30*c* is positioned to substantially maximize user comfort and substantially minimize user injury while maintaining correct exercise form.

Naturally, the weight plates can be formed of other materials so provide weight plates of different weights that have the same or similar dimensions. The use of numerous materials to form weight plates is known in the art, and the use of all such materials is within the scope of this invention.

Figure 7:
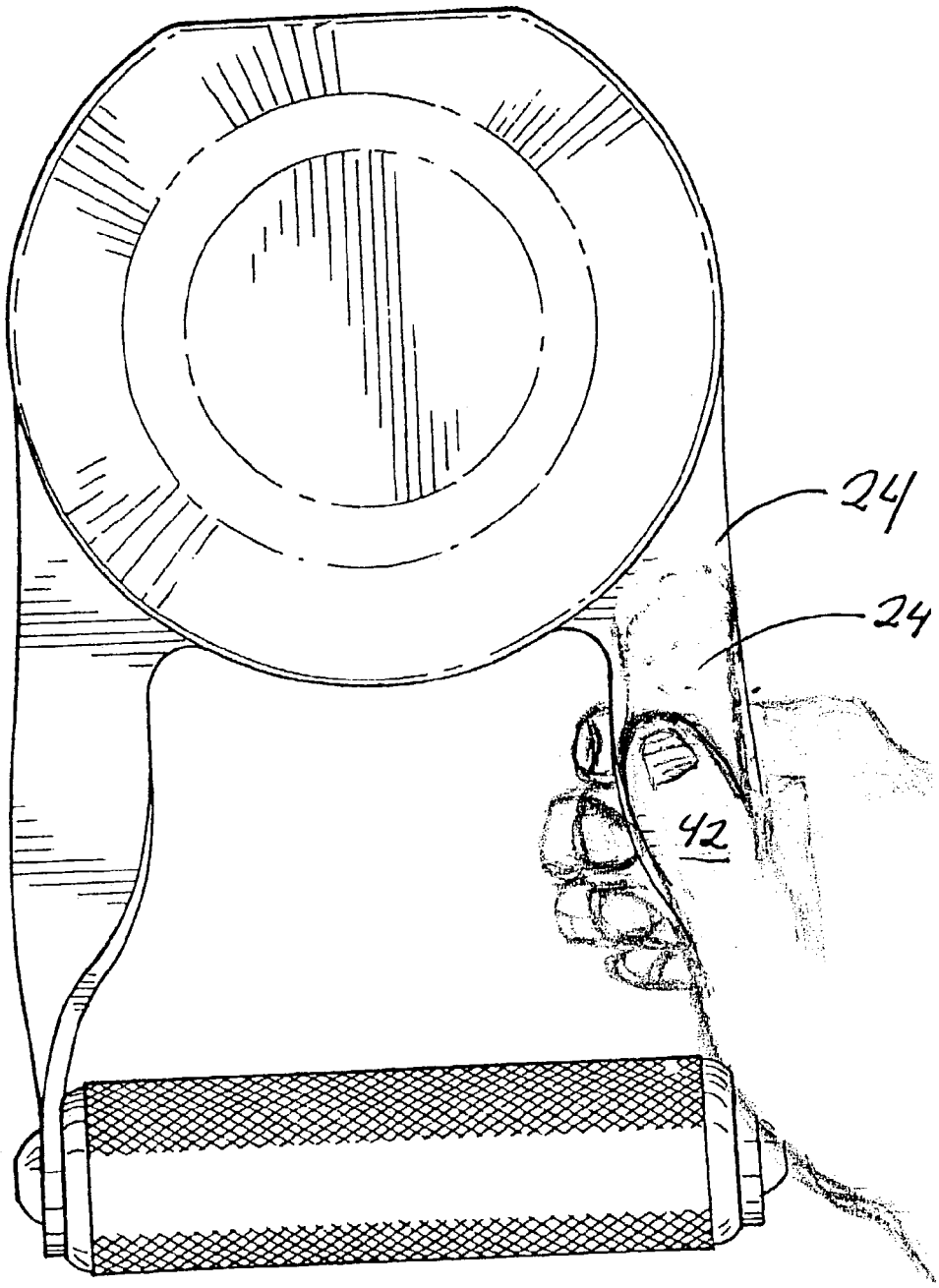
FIG. 7 illustrates the gripping of the kettlebell of FIG. 1 in another exercise.

An additional feature of the illustrated kettlebell is the user's ability to hold the kettlebell by the stems, while stabilizing it between the thumb and remaining fingers of each hand, in order to perform certain exercise movements. As illustrated in FIG. 7, the stems 24 are grasped by the user adjacent the central plate 10 where the lateral surfaces of the stem lie in roughly the same plane as the faces of the central plate. The stems are grasped by the user with the thumbs 42 on the respective stem's top lateral surface 24*a*, and with the remaining fingers of the hand encircling the respective stem to contact the bottom lateral surface 24*b* of the stem. As illustrated in FIG. 7, the side of the index fingers provide the main support, with the wrist muscles providing the strength and the thumbs cooperating with the remaining fingers to control the kettlebell.

In assembling the kettlebell, two weightplates 20 are mounted to opposite faces 12*a*, 12*b* of the central plate 12. The weightplates may be welded about their respective peripheries to the central plate, affixed with a bonding agent or via an interference fit between the weightplates and the shaft that passes through the hole 18 (FIG. 8) to couple the weightplates through the center plate.

Figure 1:
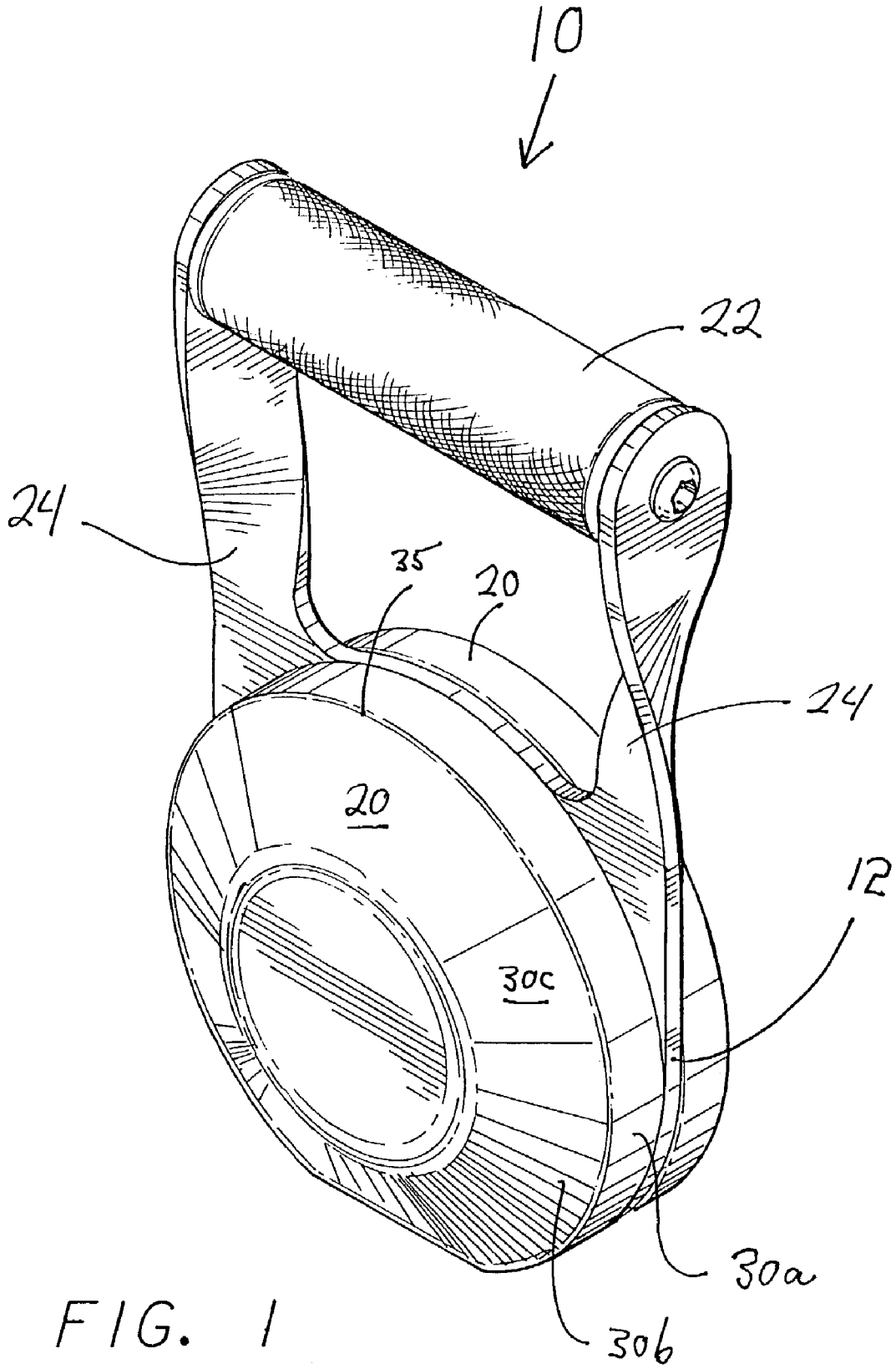
FIG. 1 is an isometric view of a preferred kettlebell constructed in accordance with the invention.
Figure 3:
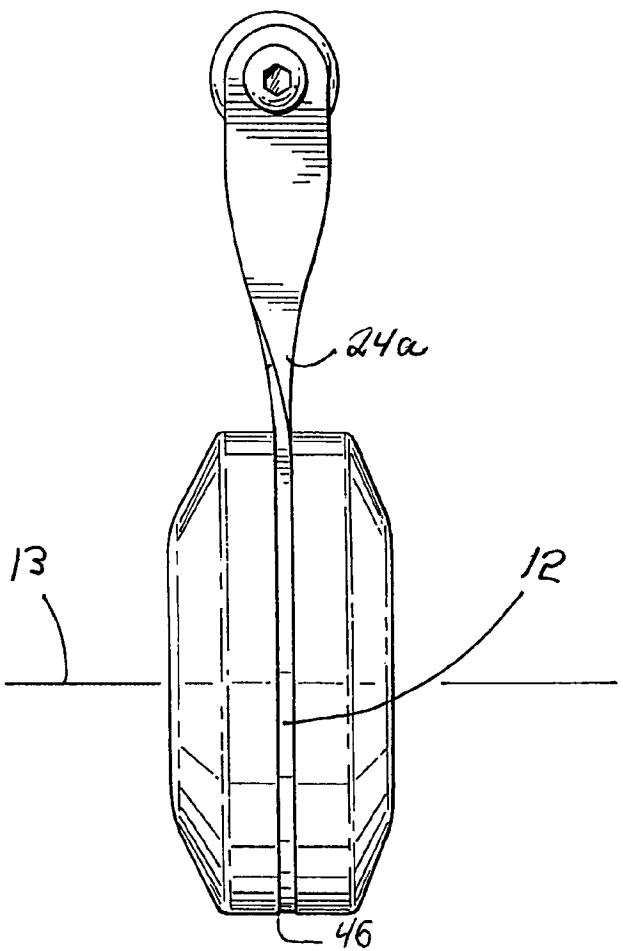
FIG. 3 is a left side elevation view of the kettle bell illustrated in FIG. 1.
Figure 2:
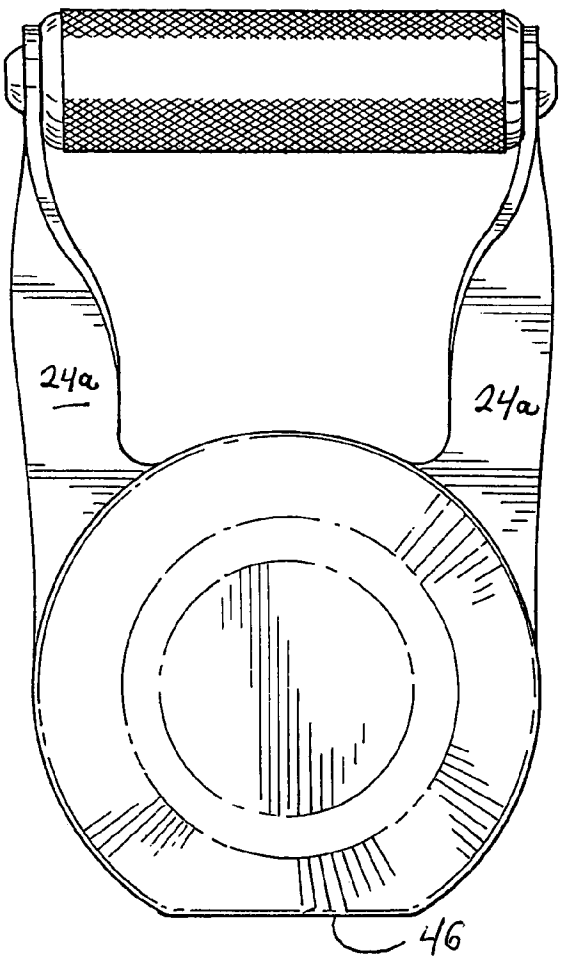
FIG. 2 is a front elevation view of the kettle bell illustrated in FIG. 1.
Figure 5:
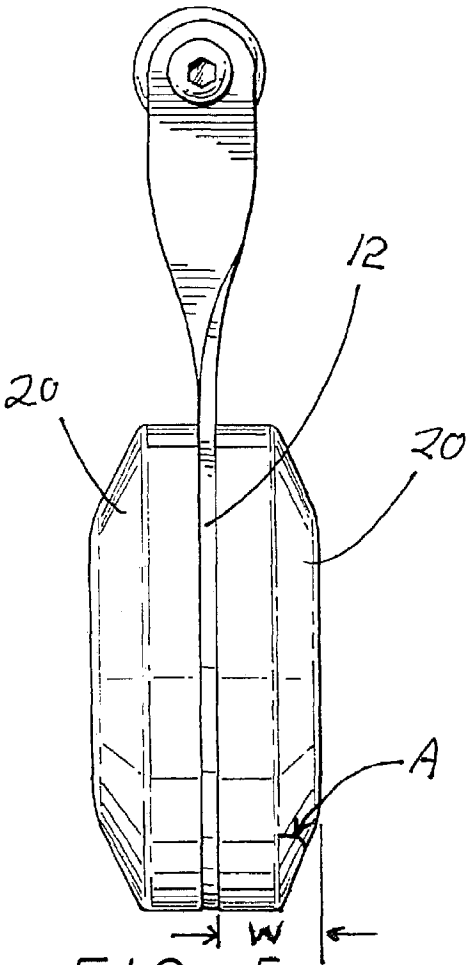
FIG. 5 is a right side elevation view of the kettle bell illustrated in FIG. 1.
Figure 4:
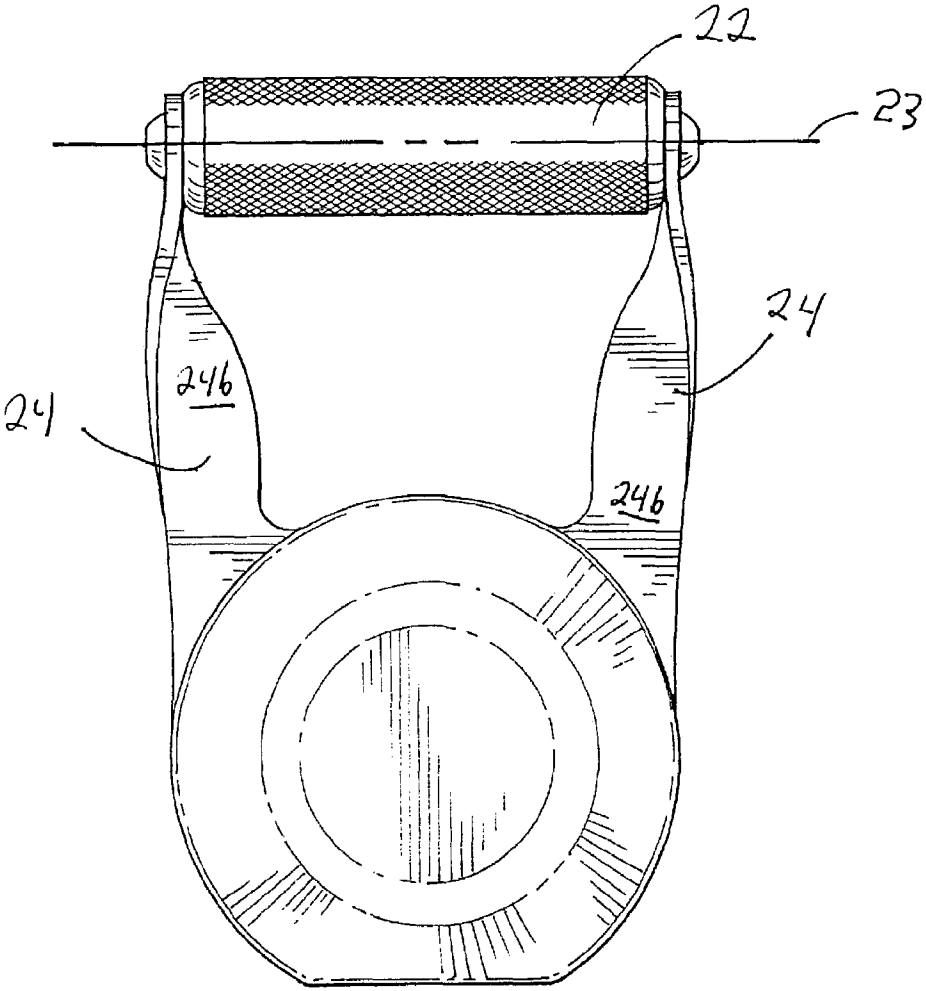
FIG. 4 is a rear elevation view of the kettle bell illustrated in FIG. 1.

As best illustrated in FIG. 2, the weightplates and central plate are preferably provided with a flat bottom surface 46 that permits the kettlebell to be placed on the floor, or other flat surface, in a stable manner. The weightplate and central plate may conveniently be provided with a matching pattern of one or more locating pins and locating holes to help align the plates during assembly so that the flat bottom surfaces, as well as the other peripheral surfaces, line up correctly as the components are affixed together.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. A kettlebell exercise device comprising:

at least one weightplate, at least a portion of thereof having a generally frustum shape disposed about a first axis;

a generally cylindrical handle sized to be gripped by a user of said kettlebell, and disposed about a second axis generally perpendicular to said first axis; and means mechanically coupling said handle to said weightplate, the frustum shape of the weightplate providing a generally obliquely oriented side surface sized and positioned to contact the user's forearm in a manner which spreads the impact force of the weightplate against the forearm when contacted during an exercise movement, the at least one frustum shaped weightplate having a back face and a relatively smaller front face with the obliquely side surface disposed therebetween, th enterface between the obliquely oriented side surface and either face forming a fulcrum region positioned, when the weightplate contacts the users forearm during an exercise movement, to contact the user's forearm in a manner that causes the weightplate to exert a countertorque in response to the flexing of the user's wrist, thereby substantially impeding such flexing, said fulcrum region having a radius of curvature that substantially prevents a sharp edge from contacting the forearm.

2. The kettlebell of claim 1 wherein the coupling means is mechanically coupled to generally diametrically opposite portions of the weightplate.

3. The kettlebell of claim 1 wherein the coupling means includes a relatively thin plate abutting, and mechanically coupled to, the weightplate.

4. A kettlebell exercise device comprising:

at least one weightplate, at least a portion of thereof having a generally frustum shape disposed about a first axis;

a generally cylindrical handle sized to be gripped by a user of said kettlebell, and disposed about a second axis generally perpendicular to and non-intersecting with said first axis; and means mechanically coupling said handle to said weightplate, the frustum shape of the weightplate providing a generally obliquely oriented side surface sized and positioned to contact the user's forearm in a manner which spreads the impact force of the weightplate against the forearm when contacted during an exercise movement, wherein the coupling means includes a pair of stems having opposite end portions respectively coupled to said weightplate and said handle, said stems extending along respective axial paths that are generally orthogonal to said first and second axes, and wherein at least a portion of each stem has a generally flat lateral surface area that provides a contact surface for the thumb of the user when the user grips the stem during an exercise movement.

5. The kettlebell of claim 4 wherein each stem is twisted approximately 90° about its axis of extension.

6. A kettlebell exercise device comprising:

at least one weightplate having front and rear faces, said weightplate generally disposed about a central axis;

a contact surface member formed along the side of the weightplate and slanting toward said central axis in the direction of the front face;

a generally cylindrical handle sized to be gripped by a user of said kettlebell, and disposed about a second axis generally perpendicular to and non-intersecting with said central axis;

means mechanically coupling said handle to said weightplate, said contact surface member being sized and positioned to contact the user's forearm in a manner which spreads the impact force of the weightplate against the forearm when contacted during an exercise movement, the front face being smaller than the rear face, with the contact surface member being provided by an obliquely oriented side surface extending between the front and rear faces, the interface between the obliquely oriented side surface and either face forming a fulcrum region positioned, when the weightplate contacts the user's forearm during an exercise movement, to contact the users forearm in a manner that causes the weightplate to exert a counter-torque in response to the flexing of the user's wrist, thereby substantially impeding such flexing, wherein the fulcrum region has a radius of curvature that substantially prevents a sharp edge from contacting the forearm.

7. The exercise device of claim 6 wherein the radius of curvature is approximately 1 inch.

8. The exercise device of claim 6 wherein the at least one weightplate is frustum shaped.

9. The exercise device of claim 6 wherein the coupling means includes a relatively thin plate abutting, and mechanically coupled to, the at least one weightplate.

10. A kettlebell exercise device comprising:

at least one weightplate having front and rear faces, said weightplate generally disposed about a central axis;

a contact surface member formed along the side of the weightplate and slanting toward said central axis in the direction of the front face;

a generally cylindrical handle sized to be gripped by a user of said kettlebell, and disposed about a second axis generally perpendicular to and non-intersecting with said central axis;

means mechanically coupling said handle to said weightplate, said contact surface member being sized and positioned to contact the user's forearm in a manner which spreads the impact force of the weightplate against the forearm when contacted during an exercise movement, the front face being smaller than the rear face, with the contact surface member being provided by an obliquely oriented side surface extending between the front and rear faces, the interface between the obliquely oriented side surface and either face forming a fulcrum region positioned, when the weightplate contacts the user's forearm during an exercise movement, to contact the users forearm in a manner that causes the weightplate to exert a counter-torque in response to the flexing of the user's wrist, thereby substantially impeding such flexing, wherein the front face of the at least one weightplate is approximately 6 inches across, and distance "W" between the front and rear faces is approximately related to the frustum angle "A" of said weight plate in accordance with the following table:

| If W (in inches) is approximately: | A (in degrees) is approximately: |
|---|---|
| 1.3 | 29 |
| 1.625 | 34 |
| 2.0 | 37 |
| 2.316 | 40 |
| 2.375 | 40 |
| 2.75 | 45. |

11. A kettlebell exercise device comprising:

at least one weightplate having front and rear faces, said weightplate generally disposed about a central axis;

a contact surface member formed along the side of the weightplate and slanting toward said central axis in the direction of the front face;

a generally cylindrical handle sized to be gripped by a user of said kettlebell, and disposed about a second axis generally perpendicular to and non-intersecting with said central axis;

means mechanically coupling said handle to said weightplate, said contact surface member being sized and positioned to contact the user's forearm in a manner which spreads the impact force of the weightplate against the forearm when contacted during an exercise movement, the front face being smaller than the rear face, with the contact surface member being provided by an obliquely oriented side surface extending between the front and rear faces, the interface between the obliquely oriented side surface and either face forming a fulcrum region positioned, when the weightplate contacts the user's forearm during an exercise movement, to contact the users forearm in a manner that causes the weightplate to exert a counter-torque in response to the flexing of the user's wrist, thereby substantially impeding such flexing, wherein the front face of the at least one weightplate is approximately 8 inches across, and distance "W" between the front and rear faces is approximately related to the frustum angle "A" of said weight plate in accordance with the following table:

| If W (in inches) is approximately: | A (in degrees) is approximately: |
|---|---|
| 1.67 | 30 |
| 1.87 | 37.5 |
| 2.07 | 39 |
| 2.27 | 41 |
| 2.48 | 43 |
| 2.665 | 44 |
| 2.85 | 45. |

* * * * *